United States Patent [19]

Kissel et al.

[11] Patent Number: 4,678,357

[45] Date of Patent: Jul. 7, 1987

[54] DEVICE FOR BINDING HOLED SHEETS

[75] Inventors: Karl-Heinz Kissel, Espelkamp; Siegfried Oevermann, Hille, both of Fed. Rep. of Germany

[73] Assignee: Robert Krause GmbH & Co. KG, Espelkamp, Fed. Rep. of Germany

[21] Appl. No.: 829,696

[22] Filed: Feb. 13, 1986

[30] Foreign Application Priority Data

Feb. 16, 1985 [DE] Fed. Rep. of Germany ... 8504460[U]

[51] Int. Cl.[4] ..... B42F 3/04

[52] U.S. Cl. ..... 402/39

[58] Field of Search ..... 402/39, 80 R

[56] References Cited

U.S. PATENT DOCUMENTS 2,088,431 7/1937 Newman ..... 402/39

4,552,478 11/1985 Cohen ..... 402/39

*Primary Examiner*—Paul A. Bell

*Attorney, Agent, or Firm*—Michael J. Striker

[57] ABSTRACT

A device for binding holed sheets or a ring book fastener includes a binding cover elastically supported by supporting elements and receiving a plurality of rings spaced from each other along the axis of the binding cover and connected thereto. Each ring is comprised of two ring halves which are releasably engageable with each other. Each ring half is provided at the end thereof cooperating with the end of the other ring half with a tooth-shaped projection engageable in a tooth gap-shaped recess of the other ring half so as to produce a lock preventing a displacement of the ring halves in the closed position in the direction transverse to the closing direction.

2 Claims, 15 Drawing Figures

Fig.5
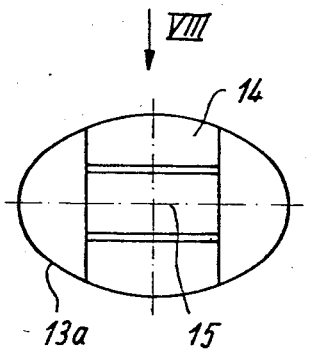
Fig.4
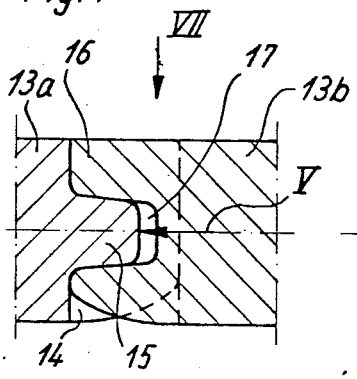
Fig.6
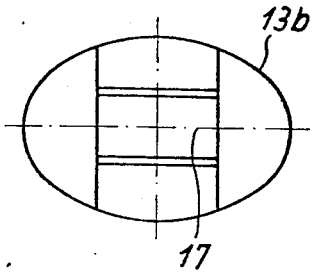
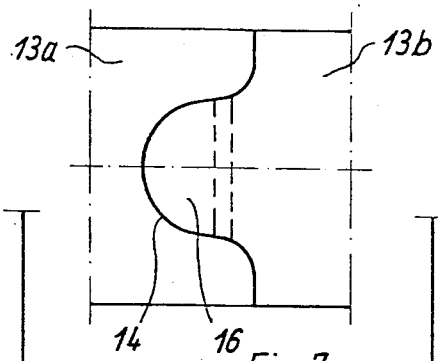
Fig. 7
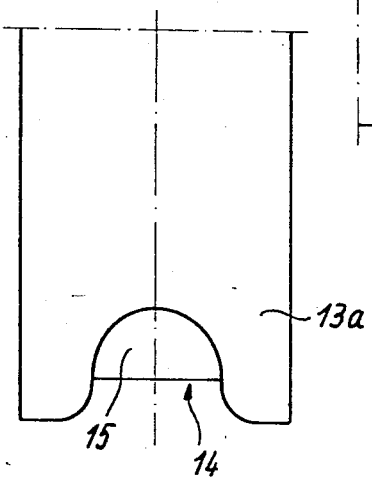
Fig.8
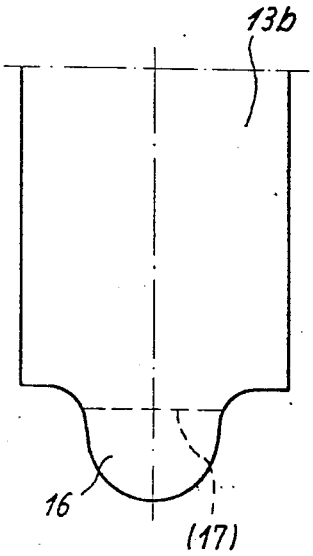
Fig.9

Fig. 11
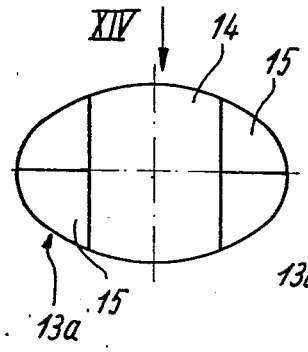
Fig. 10
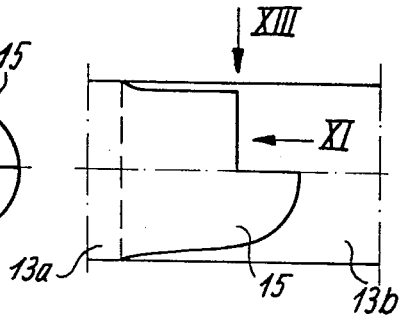
Fig. 12
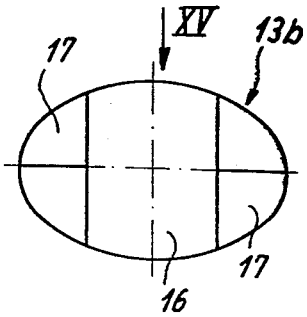
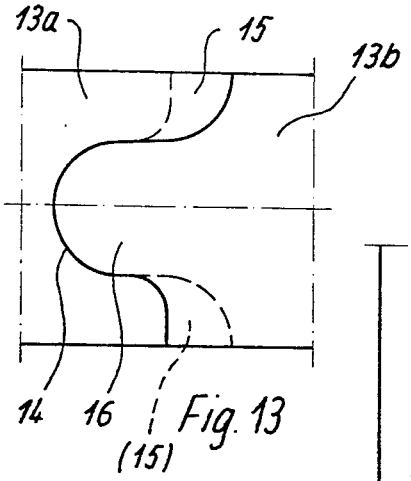
Fig. 13
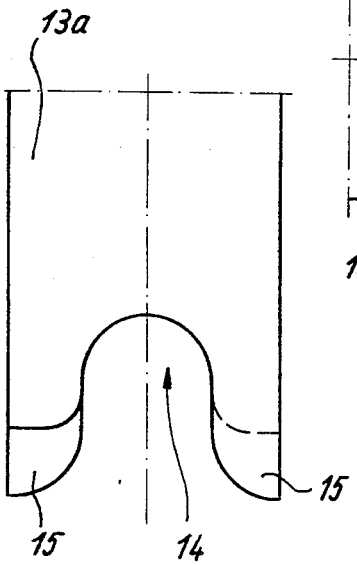
Fig. 14
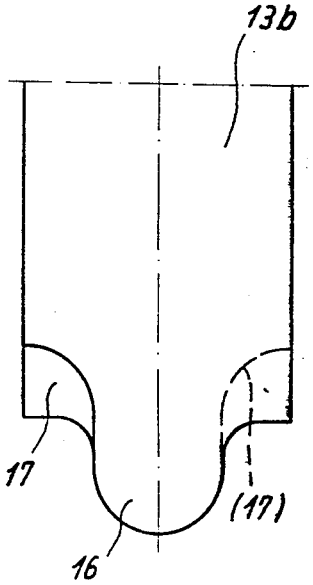
Fig. 15

DEVICE FOR BINDING HOLED SHEETS

BACKGROUND OF THE INVENTION

The present invention relates to a device for binding holed sheets.

Paper sheet-binding devices of the type under consideration are usually comprised of a book-forming binding cover, an elastic cover connectable to the binding cover, supporting elements elastically supported in the elastic cover and at least two ring halves made of metallic wire, which halves are secured in the supporting elements, on the one hand, and on the other hand, are engageable at their ends with one another.

Sheet-binding devices of the foregoing type are utilized in the wrapping industry and are identified as ring book fasteners.

In the known sheet-binding devices, in which the displacement of the cooperating ring halves relative to each other in the direction transverse of the direction of closing, a protruding pin is normally provided at the end of one ring half whereas a cylindrical bore for receiving that pin is formed in the other ring half.

A desired result is obtained by means of the above described conventional design. Namely, the displacement of both ring halves with respect to each other in the transverse direction is precluded. The disadvantage of this otherwise satisfactory device, however, resides in the fact that the manufacturing of the pin and the corresponding bore for receiving the same is comparatively expensive because a cutting process is required for making the above mentioned pin and bore.

Since the ring halves of such devices are made in mass production such an expense can be quite considerable.

SUMMARY OF THE INVENTION

It is an object of the present invention to provide an improved device for binding holed sheets.

It is another object of the invention to provide a device for binding holed sheets, which would not have the above disadvantages of conventional devices of this type and which would be inexpensive and simple in manufacture.

These and other objects of the invention are attained by a device for binding holed sheets, comprising an elastic cover connectable to a book-binding cover; supporting elements elastically supported in said elastic cover; and at least two ring halves made of metallic wire and fastened in said supporting elements, said two ring halves having ends cooperating with each other and engageable with one another so as form in a closed position a ring locked so that a displacement of said ring halves relative to each other in a direction transverse to a closing direction is prevented, said ends of said two rings each being provided with tooth-shaped projections extended in two different axes and with tooth-gap-shaped recesses receiving respective projections of the other ring half so as to form a locking connection.

The direction of axes of recesses (14, 17) may be offset by 90° to the direction of axes of said projections (15, 16).

A tooth-shaped projection (15) of one ring half (13*a*) may be positioned in a middle region of a tooth gap-shaped recess (14) of said one ring and a recess (17) of the other ring half (13*b*) may be arranged in a middle region of a tooth-shaped projection (16) of said other ring half.

The projections (15) of one ring half may be positioned outside the tooth-gap-shaped projection (14) of the one ring half, and the end of the other ring half may be provided with the recesses formed outisde the projection of said other ring half.

The projections of one ring half are engaged in the recesses of the other ring half so that a reliable lock is produced, preventing a lateral displacement of the ring halves relative to each other when they are in the closed position.

The tooth-gap recesses or tooth-shaped projections formed at the cooperating ends of two ring halves can be manufactured by very simple means, for example by a non-cutting process, for example by stamping. Thereby manufacturing of fastening rings in sheet-binding devices is substantially facilitated while the displacement of the two ring halves relative to each other in the closed position is reliably prevented as in the case of conventional devices the production of which is rather expensive.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 4 is a sectional view taken along line IV—IV of FIG. 2;

FIG. 5 is a front view of one ring half in the direction of arrow 5 of FIG. 4;

FIG. 6 is a front view of the other ring half;

FIG. 7 is a plan view in the direction of arrow VII of FIG. 4;

FIG. 8 is a view seen in the direction of arrow VIII of FIG. 5;

FIG. 9 is a plan view in the direction of arrow IX of FIG. 6;

FIG. 10 is a view of the detail X of FIG. 3, on enlarged scale;

FIG. 11 is a plan view of one ring half in the direction of arrow 11 of FIG. 10;

FIG. 12 is a front view of the other ring half of FIG. 10;

FIG. 13 is a view in the direction of arrow XIII of FIG. 10;

FIG. 14 is a view in the direction of arrow XIV of FIG. 11; and

FIG. 15 is a view in the direction of arrow XI of FIG. 12.

DETAILED DESCRIPTION OF THE PREFERRED EMBODIMENTS

Figure 1:
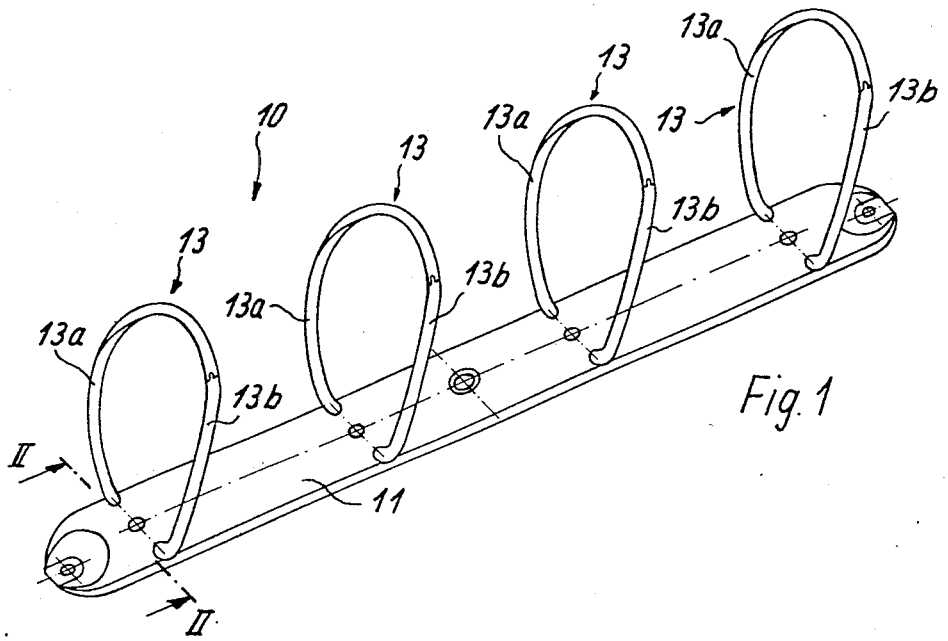
FIG. 1 is a perspective view of the device for binding holed sheets.
Figure 2:
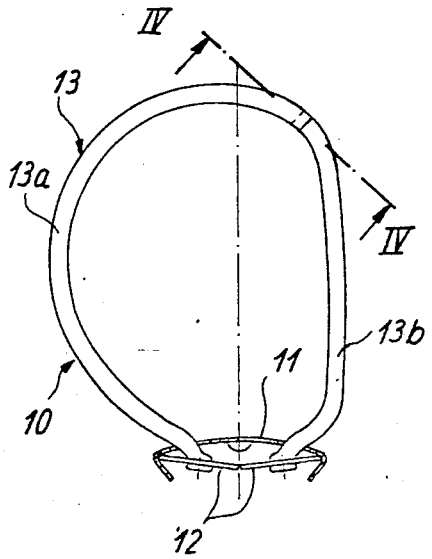
FIG. 2 is a sectional view taken on line II—II of FIG. 1.
Figure 3:
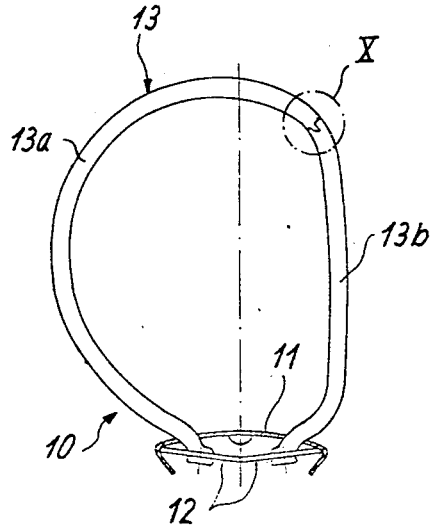
FIG. 3 is a sectional view similar to that of FIG. 2 but of a modified embodiment of the invention.

Referring now to the drawings in detail, FIG. 1 illustrates a device for binding holed sheets, designated in toto by reference numeral 10. The device is usually identified as a ring book fastener.

The device 10 substantially comprises an elastic mechanic cover 10 on which are elastically supported supporting elements 12 and rings 13. Each ring is comprised of two ring halves 13*a* and 13*b*. Each ring half 13*a*, 13*b* is fastened at its end to the supporting element 12. Both ring halves 13*a*, 13*b* form in the closed position a single closed ring. Ring halves 13*a* and 13*b* are made of metallic wire.

In order to arrange holed sheets in the device 10, rings 13 should be in an open position. This is possible by fastening of the respective ring halves 13*a* and 13*b* to the supporting elements 12 which are in turn elastically supported in the cover 11. The holed sheets can be placed on the ring halves 13*b* in the open position so that upon the closing of rings 13 the removal of the sheets could not be possible. Due to the ring-shaped construction it is also possible that the alighed sheets could be completely laminated and moved back to an initial position in the closed condition of rings 13.

In order to prevent the displacement of halves 13*a* and 13*b* of each ring 13 in the closed position transversely of the closed direction the ends of the respective ring halves 13*a* and 13*b* are formed in a specific manner.

In the embodiment shown in FIGS. 2 and 4 to 9 each ring half 13*a* is provided with a tooth-gap recess or notch 14 and with tooth-like projections 15 extended to the recess 14 at the right angles. The tooth-shaped projection 15 is positioned in the middle region of recess 14.

The opposite end of the ring half 13*b* is formed with a projection 16 which is by 90° offset relative to the formation of the ring half 13*a*. A tooth-gap recess 17 is also provided at the end of each ring half so that a form locking is obtained between the ends of ring halves 13*a* and 13*b* as shown in FIG. 4. In other words the projection 15 extends into recess 17 while recess 14 receives projection 16 whereby the displacement of the ring halves in the direction transversal to the closing direction is reliably prevented.

The formed or shaped portions of the ends of the both ring halves 13 and 13*b* can be made by a non-cuttng, for example by a stamping process.

In the embodiment shown in FIG. 3 and 10–15, the ring half 13*a* is provided with a tooth-gap-shaped recess 14. Tooth-shaped projections 15 are provided at the right angles to recess 17 at the end of the ring half 13*a*. Projections 15 are offset relative to each other at both sides in respect with to the axis extended perpendicular to the central axis of recess 14.

The end of the ring half 13*b* is formed with a tooth-shaped projection 16 which is engaged in the recess 14 of the other ring half 13*a*. The ring half 13*b* further has in its end region two recesses 17 in which the projections 15 of the other ring half 13*a* are received. The projections 15 of the ring half 13*a* are engaged in the locked or closed position in recesses 17 of the ring half 13*b*. In this embodiment, also the displacement of the ring halves 13*a* and 13*b* when they are in the closed position, in the direction transversal to the direction of closing is no longer possible. Projections 15 and 16 as well as recesses 14 and 17 have no cutting edges due to the fact that they are manufactured by a non-cutting process such as molding or stamping.

It will be understood that each of the elements described above, or two or more together, may also find a useful application in other types of devices for binding holed sheets differing from the types described above.

While the invention has been illustrated and described as embodied in a device for binding holed sheets, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for binding holes sheets, comprising an elastic cover connectable to a book-binding cover; supporting elements elastically supported in said elastic cover; and at least two ring halves made of metallic wire and fastened in said supporting elements, said two ring halves having ends cooperating with each other and engageable with one another so as form in a closed position a ring locked so that a displacement of said ring halves relative to each other in a direction transverse to a closing direction is prevented, said ends of said two ring halves each being provided with tooth-shaped projections extended in two different axes and with tooth-gap-shaped recesses receiving respective projections of the other ring half so as to form a locking connection, the direction of axes of recesses (14, 17) being offset by 90° to the direction of axes of said projections (15, 16), a toothed-shaped projection (15) of one ring half (13*a*) being positioned in a middle region of a tooth gap-shaped recess (14) of said one ring and a recess (17) of the other ring half (13*b*) being arranged in a middle region of a tooth-shaped projection (16) of said other ring half.

2. The device as defined in claim 1, wherein the projections (15) of one ring half are positioned outside the tooth-gap-shaped projection (14) of said one ring half and the end of the other ring half is formed with the recesses formed outside the projection of said other ring half.

* * * * *